US005912100A

United States Patent [19]

Aoki et al.

[11] Patent Number: 5,912,100

[45] Date of Patent: Jun. 15, 1999

[54] TONER FOR DEVELOPING ELECTROSTATIC IMAGES

[75] Inventors: Mituo Aoki, Numazu; Masanori Suzuki; Akihiro Kotsugai, both of Shizuoka-ken, all of Japan

[73] Assignee: Ricoh Company, Ltd., Tokyo, Japan

[21] Appl. No.: 08/790,713

[22] Filed: Jan. 29, 1997

[30] Foreign Application Priority Data

| | | | |
|---|---|---|---|
| Jan. 31, 1996 | [JP] | Japan | 8-015383 |
| Feb. 19, 1996 | [JP] | Japan | 8-055464 |
| Mar. 4, 1996 | [JP] | Japan | 8-070896 |

[51] Int. Cl.[6] ..... G03G 9/083

[52] U.S. Cl. ..... 430/106.6; 430/111

[58] Field of Search ..... 430/106.6, 111

[56] References Cited

U.S. PATENT DOCUMENTS

| | | | |
|---|---|---|---|
| 5,219,697 | 6/1993 | Mori et al. | 430/110 |
| 5,320,926 | 6/1994 | Ueda et al. | 430/111 |
| 5,483,329 | 1/1996 | Asanae et al. | 430/111 |
| 5,604,068 | 2/1997 | Miyamoto et al. | 430/111 |

FOREIGN PATENT DOCUMENTS

| | | |
|---|---|---|
| 0445986A1 | 9/1991 | European Pat. Off. . |
| 0488789A1 | 6/1992 | European Pat. Off. . |
| 0681218A2 | 11/1995 | European Pat. Off. . |
| 2258053 | 1/1993 | United Kingdom . |

*Primary Examiner*—John Goodrow
*Attorney, Agent, or Firm*—Cooper & Dunham LLP

[57] ABSTRACT

A toner for developing an electrostatic latent image, including toner particles having an average surface roughness of at least 0.86, wherein the average surface roughness is an average of SF1 of respective toner particles, where SF1 is defined as follows:

$$SF1=Le/Ip$$

wherein Le and Lp represent the length of the minimum envelope line and the peripheral length of each toner particle, respectively.

10 Claims, 1 Drawing Sheet

TONER FOR DEVELOPING ELECTROSTATIC IMAGES

BACKGROUND OF THE INVENTION

This invention relates to a toner for developing electrostatic images in an image forming method such as electrophotography, electrostatic printing or electrostatic recording.

In a dry copying method, an electrostatic latent image on a photosensitive medium is developed with a toner composed of a binder and a coloring agent. The developed toner image is transferred to a transfer member such as paper and fixed there. Residual toner which remains untransferred from the photosensitive medium to paper is removed with a cleaning device. From the standpoint of economy, maintenance and waste treatment, however, it is undesirable to produce waste toner.

JP-A-6-51672 discloses an image forming device including a rotatable photosensitive drum around which there are provided a developing zone, transfer zone and a cleaning zone. The cleaning zone has a cleaning roller electrically coupled with means for applying a voltage of a selected polarity. When that portion of the photosensitive drum which carries residual toner and which is fed to the cleaning zone is to be used for contacting with paper in the next transferring step, the voltage applying means is operated to apply a voltage of a polarity opposite to that of the residual toner, so that the residual toner is removed by the cleaning roller. On the other hand, when that portion of the photosensitive drum fed to the cleaning zone is not to be used for contacting with paper in the next transferring step, the voltage applying means is operated to apply a voltage of the same polarity as that of the residual toner, so that the toner removed from the photosensitive drum is again deposited to that portion of the drum. The toner thus returned to the drum is collected in the developing zone.

With this device waste toner is not produced. It has been found, however, that the transfer of the toner between the cleaning roller and the photosensitive drum is not able to be smoothly carried out. As a result, the background of copied images is apt to be stained.

SUMMARY OF THE INVENTION

The present inventors have found that the difficulty of the transfer of toner between the cleaning roller and the photosensitive drum is attributed to the properties of the toner. Namely, since conventional toner particles have angular shapes, they are tightly bound to surfaces of the drum and roller and are not smoothly separated therefrom.

It is, therefore, a prime object of the present invention to provide a toner for developing electrostatic images which exhibits excellent transfer efficiency.

Another object of the present invention is to provide a toner of the above-mentioned type which can be recovered with a high recovery rate.

In accomplishing the above object, there is provided in accordance with the present invention a toner for developing an electrostatic latent image, comprising toner particles having an average surface roughness of at least 0.86, said average surface roughness being an average of SF1 of respective toner particles, where SF1 is defined as follows:

$$SF1=Le/Lp$$

wherein Le and Lp represent the length of the minimum envelope line and the peripheral length of each toner particle, respectively.

Preferably, the toner particles have a roundness SF2 of at least 0.67, said roundness SF2 being defined as follows:

$$SF2=4S/(P^2\times\pi)$$

wherein S and P represent the area and the maximum diameter of each toner particle, respectively.

Preferably, the toner particles have an average shape index SF3 of at least 0.64, said average shape index SF3 being a product of said average of SF1 and an average of SF2, where SF1 and SF2 are as defined above. "MINIMUM ENVELOPE LINE", "PERIPHERAL LENGTH", "AREA" and "MAXIMUM DIAMETER" of toner particles are measured by a reflection-type scanning electron microscope (SEM). These terms are defined as follows:

MINIMUM ENVELOPE LINE is the minimum length line surrounding the SEM pattern of a given particle. In the case of a particle shown in FIG. 1, for example, the minimum envelope line is as designated as MCL;

PERIPHERAL LENGTH is the length of the outer periphery of the SEM pattern. In the case of FIG. 1, the peripheral length is the length of the peripheral line PL;

AREA in an area of the SEM pattern. In the case of FIG. 1, the area is that of the portion defined by the peripheral line PL;

MAXIMUM DIAMETER is the maximum length of a line extending between two points on the peripheral line of the SEM pattern. In the case of FIG. 1, the maximum diameter is the length of a line MD.

BRIEF DESCRIPTION OF THE DRAWINGS

Other objects, features and advantages of the present invention will become apparent from the detailed description of the preferred embodiments of the invention which follows, when considered in light of the accompanying drawings, in which.

DETAILED DESCRIPTION OF THE PREFERRED EMBODIMENTS OF THE INVENTION

Figure 1:
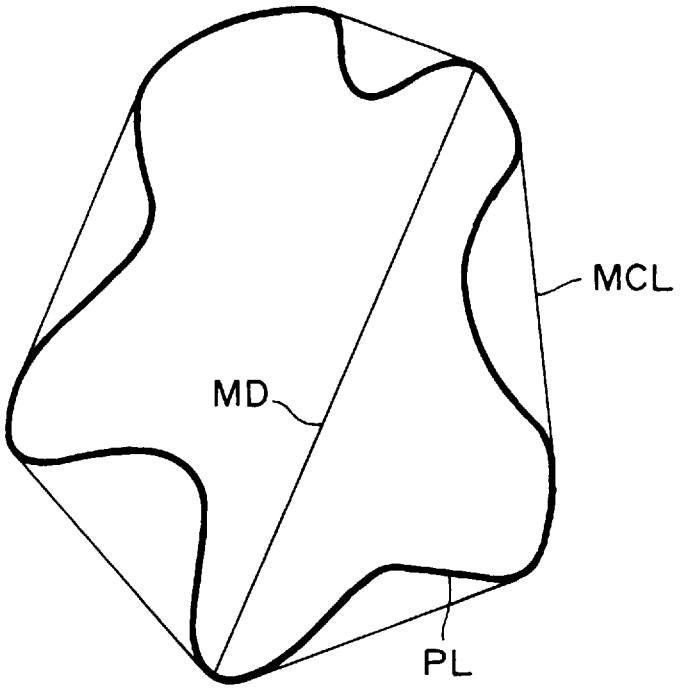
FIG. 1 is a schematic illustration of a SEM pattern of a toner particle.
Figure 2:
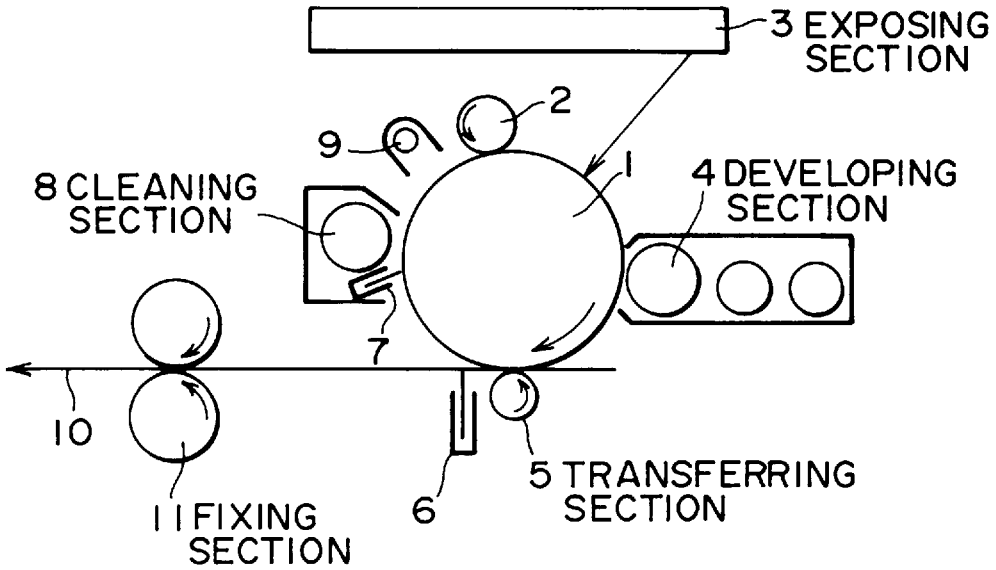
FIG. 2 is a sectional view schematically illustrating an image forming device for which the toner according to the present invention is suitably used.

Referring to FIG. 2, designated as 1 an image carrier, generally a photosensitive drum having a surface organic photoconductive layer. The drum 1 is rotated about the axis thereof and adapted to carry a toner image thereon. Arranged around the circumference of the drum 1 are a charging roller 2, an exposing section 3, a developing device 4, a transfer roller 5, a separation charger 6, cleaning charger 7, a cleaning roller 8 and a discharge lamp 9.

The photosensitive drum 1 is electrified by the charger 2 at, for example, −700 V and imagewise exposed to a laser beam in the exposing section 3 to form a latent image (the potential at the exposed portion is, for example, about −100 V). The latent image on the drum 1 is then developed by the developing device 4 such as a magnetic brush (impressed voltage is, for example, −550 V) to form a toner image. A transfer medium such as paper 10 is fed between the drum 1 and the transfer roller 5, where the toner image is transferred to the paper 10. The transfer bias voltage applied to the transfer roller 5 is, for example, +950 V. The paper 10 carrying the transferred toner image is fed between fixation rollers 11 to fix the toner image thereon.

Toner particles which remain untransferred in the transfer step are positively charged, since the transfer roller is applied with a positive bias voltage. Such toner remaining on the drum 1 is negatively charged when subjected to a corona discharge by the precharger 7. The cleaning roller 8 is applied with a positive bias voltage and is slowly rotated in one direction. Thus, the negatively charged toner remaining on the drum 1 is transferred to the cleaning roller 8 during passage thereof through the cleaning zone including the cleaning roller 8. The drum 1 from which the toner has been removed and which is negatively charged is then passed through the discharge lamp 9 where the negative charge is removed.

As soon as the removal of the remaining toner on the drum 1 by the cleaning roller 8 has been completed, the cleaning roller 8 is rotated in opposite direction and/or at a different speed. Simultaneously, the cleaning roller 8 is applied with a negative bias voltage so that the toner previously removed from the drum 1 is transferred onto the drum 1. The thus transferred toner on the drum 1 is then carried to the developing zone including the magnetic brush 4. In order to smoothly pass the toner on the drum 1 to the developing zone, the charger 2 is spaced apart from the surface of the drum 1. The magnetic brush 4 of the developing device is applied with a positive bias voltage so that the toner on the drum 1 is recovered by the magnetic brush 4.

Thus, by selectively switching the polarity of the bias voltage applied to the cleaning roller 8 and the magnetic brush, the toner remaining on the drum 1 can be removed and recovered.

The present invention provides a toner which can be effectively used in the above-described toner image-forming system or device and which includes toner particles.

It is important that the toner particles having an average surface roughness of at least 0.06. The average surface roughness is an average of SF1 of respective toner particles, where SF1 is defined as follows:

$$SF1=Le/Lp$$

wherein Le and Lp represent the length of the minimum envelope line and the peripheral length of each toner particle, respectively.

When the average surface roughness is less than 0.86, the surfaces of the toner particles are not smooth so that the toner particles are not easily separated from surfaces of cleaning roller 8 or drum 1. Further, in the case of a two-components developing agent composed of a carrier and a toner, the toner is apt to be fuse bonded to the carrier during repeated use.

It is preferred that the toner particles have a roundness SF2 of at least 0.67 for reasons of improved transferability of the toner between the cleaning roller 8 and the drum 1 and improved service life. The roundness SF2 is defined as follows:

$$SF2=4S/(P^2\times\pi)$$

wherein S and P represent the area and the maximum diameter of each toner particle, respectively.

It is further preferred that the toner particles have an average shape index SF3 of at least 0.64 for reasons of good balance toner transferability and service life. The average shape index SF3 is a product of the average of SF1 and an average of SF2, where SF1 and SF2 are as defined above.

It is also preferred that the toner particles be mixed with silicon oxide particles having a diameter not greater than 1/10 of the volume average particle diameter of the toner particles for reasons of improved toner transferability. The silicon oxide is generally used in an amount of 5% by weight or less, preferably 2% by weight or less, based on the total weight of the silicon oxide and the toner particles.

It is also preferred that the toner have a volume specific resistance in the range of between $1\times10^{10}$ and $3\times10^{12}$ Ωcm for reasons of prevention of stains in the background of the copied images.

It is also preferred that the toner particles have such a volume average particle diameter Dv and a number average particle diameter Dn that the following condition is satisfied:

$$Dn/Dv\leqq1.3$$

for reasons of (a) prevention of stains in the background of the copied images and (b) improved reproducibility of toner images in the form of dots.

It is further preferred that each of the toner particles contain magnetic particles having an average diameter of between 0.01 and 0.20 μm for reasons of (a) prevention of stains in the background of the copied images,(b) improved reproducibility of toner images in the form of dots and (c) improved toner recovery in the developing zone including the magnetic brush 4. When the particle size is greater than 0.20 μm, it is difficult to uniformly disperse the magnetic particles into the toner. Too small a particle size below 0.01 μm is undesirable because the magnetism is unsatisfactory. The "particle size" herein is that measured by SEM.

The magnetic material may be, for example, iron oxide (e.g. magnetite, ferrite or hematite), metallic cobalt or nickel, an alloy of iron, cobalt and/or nickel with one or more metals such as aluminum, copper, lead, magnesium, tin, zinc, antimony, beryllium, bismuth, cadmium, calcium, manganese, selenium, titanium, tungsten and vanadium. Above all, use of magnetite is preferred. The magnetic particles are preferably used in an amount of 20–40 parts by weight per 100 parts by weight of the binder resin of the toner.

It is preferred that the toner particles have a volume average diameter of between 5 and 9 μm for reasons of (a) prevention of stains in the background of the copied images, (b) improved reproducibility of toner images in the form of dots and (c) improved toner recovery in the developing zone including the magnetic brush 4.

It is further preferred that each of the toner particles contain at least 50% by weight of a polyester resin as a binder resin for reasons of improved shelf life and improved fixation at a low temperature. The polyester resin is obtained by polycondensation of an alcohol and a carboxylic acid. Examples of the alcohols include glycols such as ethylene glycol, diethylene glycol, triethylene glycol and propylene glycol, bisphenols such as 1,4-bis(hydroxymethyl) cyclohexane and bisphanol A, and other polyhydric alcohols. Examples of the carboxylic acids include dicarboxylic acids such as maleic acid, fumaric acid, phthalic acid, isophthalic acid, terephthalic acid, succinic acid and malonic acid, and tri- or higher polycarboxylic organic acid such as 1,2, 4-benzenetricarboxylic acid 1,2,5-benzentricarboxylic acid, 1,2,4-cyclohpxanetricarbcxylic acid, 1,2,4-naphthalenetricarboxylic acid, 1,2,5-hexanetricarboxylic acid, 1,3-dicarboxyl-2methylenecarboxypropane and 1,2,7, 8-octanetetracarboxylic acid. The polyester resin preferably has Tg of 65–75° C. for reasons of improved shelf life and improved fixation property.

It is further preferred that each of the toner particles contain from 5 to 20% by weight, preferably 5–10% by weight, of a petroleum resin having a hydrogenation degree of at least 50%, preferably at least 75%, for reasons of improved shelf life and improved fixation at a low temperature. A petroleum resin is obtained by polymerizing a specific fraction which is produced as by-product in the production of styrene, acetylene, propylene, etc. by decomposition of naphta and may be, for example, that obtained from a C5–C8 fraction, a C5–C6 fraction or alphatic-aromatic fraction. In the present invention, the use of a petroleum resin obtained from dicyclopentadiene and C6–C8 aromatic hydrocarbons is desirable. The hydrogenated petroleum resin preferably has a softening point (ring and ball method; Japanese Industrial Standard JIS K1863–1994) of 90–140° C., more preferably 100–130° C.

The toner according to the present invention is formed of a binder and a coloring agent. The binder is preferably a polyester resin, a hydrogenated petroleum resin or a mixture thereof as described above. Examples of other binder resins include a homopolymer of styrene or a styrene derivative such as polystyrene, poly(p-chlorostyrene) or poly (vinyltoluene); a styrene copolymer such as a styrine-p-chlorostyrene copolymer, a styrene-propylene copolymer, a styrene-vinyltoluene copolymer, a styrene-vinylnaphthalene copolymer, a styrene-methyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl α-chloromethacrylate copolymer, a styrene-acrylonitrile copolymer, a styrene-vinyl methyl ketone copolymer, a styrene-butadiene copolymer, a styrene-isoprene copolymer, a styrene-acrylonitrile-indene terpolymer, a styrene-maleic acid copolymer or a styrene-maleate copolymer; poly (methyl methacrylate); poly(butyl methacrylate); poly(vinyl chloride); poly(vinyl acetate); polyethylene; polypropylene, polyester; polyurethane; polyamide; an epoxy resin; poly (vinyl butyral); poly(acrylic acid); rosin; modified rosin; a terpene resin; an aliphatic or alicyclic hydrocarbon resin; chlorinated paraffin; or paraffin wax. These resins may be used by themselves or as a mixture of two or more.

Illustrative of suitable binder resins for use in fixation under a pressure are polyolefins such as low molecular weight polyethylene (MW: 1,000–5,000), low molecular weight polypropylene (MW: 1,000–5,000), oxidized polyethylene and poly(4-fluoroethylene); epoxy resins; polyesters, styrene-butadiene copolymers (monomer ratio: (5–30):(95–70)); olefin copolymers such as ethylene-acrylic acid copolymers, ethylene-acrylate copolymers, ethylene-methacrylic acid copolymers, ethylene-methacrylate copolymers, ethylene-vinyl chloride copolymers, ethylene-vinyl acetate copolymers and ionomer resins); polyvinylpyrrolidones; methyl vinyl ether-maleic anhydride copolymers; maleic acid-modified phenol resins and phenol-modified terpene resins.

Any known colorant may be used for the purpose of the invention. The colorant may be a black colorant such as carbon black, aniline black, furnace black, lamp black or iron black; a cyan colorant such as phthalocyanine blue, methylene blue Victoria blue, methyl violet, ultramarine blue or aniline blue; a magenta colorant such as rhodamine 6 G lake, dimethylquiriacridone, watching red, rose bengal, rhodamine B or alizarin lake; or a yellow pigment such as chrome yellow, benzidine yellow, hansa yellow G, naphthol yellow, quinoline yellow or tartrazine. These colorants may be used by themselves or in combination with two or more.

The toner preferably contains a customarily employed charge controlling agent. Illustrative of suitable positively charging agents are nigrosine, basic dyes, lake pigments of basic dyes and quaternary ammonium salts. Illustrative of suitable negatively charging agents are metal salts of monoazo dyes, salicylic acid, naphthoic acid and metal complexes of dicarboxylic acids.

The toner according to the present invention may contain one or more additives, if desired. Illustrative of additives are a lubricant such as tetrafluoroethylene or zinc stearate; an abrasive such as cerium oxide or silicon carbide; a flowability improving agent (caking-prevention agent) such as colloidal silica or aluminum oxide; an electrical conductivity-imparting agent such as carbon black or tin oxide, a fixation adjuvant such as a low molecular weight polyolefin; and a mold release agent such as solid silicone vanish, higher aliphatic alcohol, a low molecular weight polypropylene, a low molecular weight polyethylene, carnauba wax, microcrystalline wax, rice wax, hohoba wax or montaic acid wax. The mold release agent is generally used in an amount of 1–20 parts by weight, preferably 3–10 parts by weight, per 100 parts by weight of the binder resin of the toner.

The toner of the present invention is suitably used as a two-component-type developing system in conjunction with carrier particles which may be (a) magnetic particles such as of metals, compounds and alloys of iron, cobalt and nickel, (b) glass beads or (c) composite particles composed of the above magnetic particles or glass beads each coated with a layer of a resin. Illustrative of suitable resin for forming the resin coating are styrene-acrylate copolymers preferably having a styrene content of 30–90% by weight, silicone resins, maleic acid resins, fluorine resins, polyester resins and epoxy resins. The resin coating may further contain one or more additives such as an adhesion improver, a curing agent, a lubricant, an electrically conductive agent and a charge controlling agent.

The toner may be produced by any known method such as a pulverization method or a polymerization method, e.g. solution polymerization, emulsion polymerization, suspension polymerization or block polymerization.

The following examples will further illustrate the present invention. Parts are by weight.

Preparation of Carrier

| | | |
|---|---|---|
| Silicone resin (KR250 manufactured by Shinetsu Silicone Inc.) | 100 | parts |
| Carbon black (#44 manufactured by Mitsubishi Chemical Industry Inc.) | 4 | parts |
| Toluene | 100 | parts |

The above composition was mixed with a mixer for 30 minutes to form a dispersion. The dispersion was charged into a fluidized bed-type coating device together with 1,000 parts of ferrite particles having an average particle diameter of 100 μm. The ferrite particles thus coated were dried to obtain Carrier A.

EXAMPLES 1–5

| | | |
|---|---|---|
| Polyester resin (weight average molecular weight: 250,000) | 80 | parts |
| Styrene-methyl methacrylate copolymer | 20 | parts |
| Wax (acid value: 15) | 4 | parts |
| Carbon black (#44 manufactured by Mitsubishi Chemical Industry Inc.) | 8 | parts |
| Metal complex dye | 2 | part |

The above composition was thoroughly mixed with a Henschel mixer and then kneaded at a temperature of 130–140° C. for about 30 minutes with a roll mill. The kneaded mixture was cooled to room temperature and the solidified mass was ground with a jet-type mill and sieved to obtain a toner having a volume average particle diameter of 10 μm. The ground product (100 parts) was mixed with 0.3 part of silicon oxide (R-972 manufactured by Nihon Aerosil Inc.; particle size: 0.15 μm) using a Henschel mixer to obtain a, toner product. By varying the residence time with the jet-type mill, various ground products with different SF1, SF2 and SF3 were obtained.

Each toner product (2.5 parts) was mixed with 97.5 parts of the above Carrier A using a ball mill to obtain a developer.

EXAMPLE 6

Example 1 was repeated in the same manner as described except that the amount of carbon black was reduced to 0.5 part, thereby obtaining a toner product. The toner product (2.5 parts) was mixed with 97.5 parts of the above Carrier A using a ball mill to obtain a developer.

EXAMPLE 7

Example 1 was repeated in the same manner as described except that the metal complex dye was not used, thereby obtaining a toner product. The toner product (2.5 parts) was mixed with 97.5 parts of the above Carrier A using a ball mill to obtain a developer.

EXAMPLE 8

Example 1 was repeated in the same manner as described except that the ground product was classified prior to the mixing with the silicon oxide, thereby obtaining a toner product. The toner product (2.5 parts) was mixed with 97.5 parts of the above Carrier A using a ball mill to obtain a developer.

EXAMPLE 9

Example 8 was repeated in the same manner as described except that silicon oxide was not used at all, thereby obtaining a toner product. The toner product (2.5 parts) was mixed with 97.5 parts of the above Carrier A using a ball mill to obtain a developer.

EXAMPLE 10

| | | |
|---|---|---|
| Styrene-methylmethacrylate copolymer (weight average molecular weight: 100,000) | 45 | parts |
| Magnetite powder (average particle size: 0.5 μm) | 45 | parts |
| Carnauba wax | 5 | parts |
| Carbon black (#44 manufactured by Mitsubishi Chemical Industry Inc.) | 3 | parts |
| Metal complex dye | 2 | part |

The above composition was thoroughly mixed with a Henschel mixer and then kneaded at a temperature of 130–140° C. for about 30 minutes with a toll mill. The kneaded mixture was cooled to room temperature and the solidified mass was ground with a jet-type mill and sieved to obtain a toner having a volume average particle diameter of 10 μm. The ground product (100 parts) was mixed with 0.3 part of silicon oxide (R-972 manufactured by Nihon Aerosil Inc.; particle size: 0.15 μm) using a Henschel mixer to obtain a toner product. The toner product (3.5 parts) was mixed with 96.5 parts of the above Carrier A using a ball mill to obtain a developer.

EXAMPLE 11

| | | |
|---|---|---|
| Styrene-methylmethacrylate copolymer (weiqht average molecular weight: 100,000) | 45 | parts |
| Magnetite powder (average particle size: 0.5 μm) | 46 | parts |
| Carnauba wax | 5 | parts |
| Carbon black (#44 manufactured by Mitsubishi Chemical Industry Inc.) | 3 | parts |
| Metal complex dye | 2 | part |

The above composition was thoroughly mixed with a Henschel mixer and then kneaded at a temperature of 130–140° C. for about 30 minutes with a roll mill. The kneaded mixture was cooled to room temperature and the solidified mass was ground with a jet-type mill and sieved to obtain a toner having a volume average particle diameter of 7.5 μm. The ground product (100 parts) was mixed with 0.4 part of silicon oxide (R-972 manufactured by Nihon Aerosil Inc.; particle size: 0.15 μm) using a Henschel mixer to obtain a toner product. The toner product (3.5 parts) was mixed with 96.5 parts of the above Carrier A using a ball mill to obtain a developer.

EXAMPLE 12

| | | |
|---|---|---|
| Polyester resin (weight average molecular weight: 250,000) | 60 | parts |
| Styrene-methylmethacrylate copolymer (weight average molecular weight: 100,000) | 30 | parts |
| Magnetite powder (average particle size: 0.5 μm) | 45 | parts |
| Carnauba wax | 5 | parts |
| Carbon black (#44 manufactured by Mitsubishi Chemical Industry Inc.) | 3 | parts |
| Metal complex dye | 2 | part |

The above composition was thoroughly mixed with a Henschel mixer and then kneaded at a temperature of 130–140° C. for about 30 minutes with a roll mill. The kneaded mixture was cooled to room temperature and the solidified mass was ground with a jet-type mill and sieved to obtain a toner having a volume average particle diameter of 7.5 μm. The ground product (100 parts) was mixed with 0.4 part of silicon oxide (R-972 manufactured by Nihon Aerosil Inc.; particle size: 0.15 μm) using a Henschel mixer to obtain a toner product. The toner product (3.5 parts) was mixed with 96.5 parts of the above Carrier A using a ball mill to obtain a developer.

EXAMPLES 13 and 14

| | | |
|---|---|---|
| Polyester resin (weight average molecular weight: 250,000) | 53 | parts |
| Hydrogenated petroleum resin (softening point: 100° C.; hydrogenation degree: 95%) | 10 | parts |
| Styrene-methyl methacrylate copolymer (weight average molecular weight: 100,000) | 25 | parts |
| Magnetite powder (average particle size: 0.5 μm) | 45 | parts |
| Carnauba wax | 5 | parts |
| Carbon black (#44 manufactured by Mitsubishi Chemical Industry Inc.) | 3 | parts |
| Metal complex dye | 2 | part |

The above composition was thoroughly mixed with a Henschel mixer and then kneaded at a temperature of 130–140° C. for about 30 minutes with a roll mill. The kneaded mixture was cooled to room temperature and the solidified mass was ground with a jet-type mill and sieved to obtain a toner having a volume average particle diameter of 7.5 μm. The ground product (100 parts) was mixed with 0.4 part of silicon oxide (R-972 manufactured by Nihon Aerosil Inc.; particle size: 0.15 μm) using a Henschel mixer to obtain a toner product. The toner product (3.5 parts) was mixed with 96.5 parts of the above Carrier A using a ball mill to obtain a developer.

Each of the ground products (not yet mixed with silicon oxide) obtained in Examples 1–14 was measured for its values of SF1, SF2 and SF3 by SEM. Thus, 15 samples were arbitrarily selected at random for each ground product. SEM patterns of the 15 samples of each ground product were analyzed with an image analyzer (Ruzex IIIU manufactured by Nicore Co., Ltd.) to determine SF1 and SF2 thereof. The results are summarized in Table 1. Further, the ground products of Examples 1–14 were each measured for their volume specific resistance and Dn/Dv (ratio of number average particle diameter to volume average particle diameter (measured by dynamic light scattering method)) to give the results shown in Table 1.

Each of the toner products obtained in Examples 1–14 was tested for its transferability, recovery rate, background stains, dot image reproducibility, amount of charge in the developing zone and amount of charge downstream of the transferring zone using a copying machine (ME-530 manufactured by Ricoh company, Ltd. and modified to have a construction as shown in FIG. 2) operated under the following conditions.

Image carrier 1: drum having a diameter of 60 mm and coated with an organic photoconductive layer Charging roller 2: electroconductive rubber roller having a diameter of 15 mm Developing roller 4: diameter of 15 mm Transfer roller 5: electroconductive rubber roller having a diameter of 15 mm Cleaning roller 8: electroconductive sponge roller having a diameter of 15 mm Peripheral velocity of image carrier 1: 150 mm/sec Fixing rollers 11: combination of an upper hard TEFLON roller with a lower soft TEFLON roller Exposing section 3: laser beam (600 dpi) irradiation system The test methods are as follows:

Transferability

The copying machine was continuously operated to obtain 10,000 copies. Thereafter, the toner on the drum 1 was collected on an adhesive tape and the amount thereof was measured. Transferability (%) is determined as follows:

$$\text{Transferability}=A/B\times 100$$

wherein A represents an amount of the toner on a portion of the drum immediately downstream of the cleaning roller 8 and B represents an amount of the toner on the corresponding portion immediately upstream of the cleaning roller 8.

Recovery rate

After producing 10,000 copies, a surface (corresponding to the background portion) of the drum 1 located between the developing roller 4 and the transfer roller 5 was applied with an adhesive tape so that the toner remaining on the drum 1 was transferred to the tape. The amount of the toner on the tape was measured with McBeath densitometer for the evaluation of recovery rate according to the following ratings:

A: excellent (substantially no toner remains on the drum 1)

B: good

C: fair

D: no good

E: poor

Background stains

The background of the copy obtained at 10,000th operation was measured with McBeath densitometer for the evaluation of recovery rate according to the following ratings:

A: excellent

B: good

C: fair

D: no good

E: poor

Dot image reproducibility

The dot image of the copy obtained at 10,000th operation was measured with a microscope for the evaluation of image reproducibility according to the following rating:

A: excellent

B: good

C: fair

D; no good

E: poor

Amount of charge in the developing zone

Toner on that portion of the drum which existed at the developing zone was collected to measure the amount of charge thereof.

Amount of charge downstream of the transferring zone

Toner on that portion of the drum which had passed the transferring zone but had not yet been fed to the cleaning zone was collected to measure the amount of charge thereof.

Tests were also performed for evaluating minimum fixation temperature and shelf life of the toner according to the following methods:

Minimum fixation temperature

Sample toner product (3 parts) was mixed with 97 parts of the above Carrier A using a ball mill to obtain a developer. This was charged in a copying machine (Imagio MF530 manufactured by Ricoh Company Ltd.) and copies having an image density of 1.2 (McBeath densitometer) were produced at various fixation temperatures. The image was rubbed 10 times with a sand rubber eraser mounted on a clock meter and the density $D_1$ of the rubbed image was measured with McBeath densitometer to determine fixation rate R (%) according to the following equation:

$$R=D_1/1.2\times 100$$

The minimum fixation temperature is a temperature at which the fixation rate of 70% is obtained.

Shelf life

Toner sample was packed in a glass vessel and allowed to stand at 60° C. for 4 hours. After cooling to 24° C., the toner was subjected to penetration test according to Japanese Industrial Standard JIS K2235-1991. The larger the penetration (mm), the better is the thermal stability (shelf life).

The test results are shown in Tables 2 and 3.

TABLE 1

| Example No. | Average SF1*1 | Average SF2*2 | SF3 (SF1 × SF2) | Dn/Dv | Resistivity (Ω · cm) |
|---|---|---|---|---|---|
| 1 | 0.90 | 0.61 | 0.54 | 1.31 | $2.5 \times 10^{12}$ |
| 2 | 0.84 | 0.70 | 0.58 | 1.33 | $2.5 \times 10^{12}$ |
| 3 | 0.91 | 0.77 | 0.68 | 1.31 | $2.5 \times 10^{12}$ |
| 4 | 0.89 | 0.76 | 0.70 | 1.33 | $2.5 \times 10^{12}$ |
| 5 | 0.69 | 0.56 | 0.39 | 1.34 | $2.5 \times 10^{13}$ |
| 6 | 0.87 | 0.68 | 0.65 | 1.31 | $5.5 \times 10^{12}$ |
| 7 | 0.70 | 0.57 | 0.39 | 1.31 | $2.5 \times 10^{12}$ |
| 8 | 0.90 | 0.75 | 0.69 | 1.29 | $2.5 \times 10^{12}$ |
| 9 | 0.90 | 0.75 | 0.69 | 1.29 | $2.5 \times 10^{12}$ |
| 10 | 0.70 | 0.55 | 0.39 | 1.33 | $1.9 \times 10^{11}$ |
| 11 | 0.71 | 0.57 | 0.40 | 1.34 | $2.0 \times 10^{12}$ |
| 12 | 0.69 | 0.56 | 0.39 | 1.33 | $2.7 \times 10^{12}$ |
| 13 | 0.68 | 0.58 | 0.39 | 1.40 | $3.0 \times 10^{12}$ |
| 14 | 0.91 | 0.77 | 0.68 | 1.41 | $3.0 \times 10^{12}$ |

*1: Average of 15 samples
*2: Average of 15 samples

TABLE 2

| Example No. | transfer-ability (%) | recovery rate | background stains | dot image reproducibility |
|---|---|---|---|---|
| 1 | 94 | C–B | B | B |
| 2 | 95 | C–B | B | B |
| 3 | 98 | B–A | A | B |
| 4 | 98 | B–A | A | B |
| 5 | 85 | C | D | B |
| 6 | 94 | C | A | B |
| 7 | 83 | C | D | B |
| 8 | 98 | B–A | A | B |
| 9 | 95 | B–A | A | B |
| 10 | 86 | B | C–B | B |
| 11 | 87 | B | C–B | B |
| 12 | 86 | B | B | B |
| 13 | 86 | B | B | B |
| 14 | 98 | A | B | B |

TABLE 3

| Example No. | Amount*1 (μC/g) | Amount*2 (μC/g) | Min. Temp. (° C.) | Shelf Life (mm) |
|---|---|---|---|---|
| 1 | −19.2 | 3.4 | 130 | 30 |
| 2 | −18.6 | 2.7 | 130 | 30 |
| 3 | −19.3 | 2.0 | 130 | 30 |
| 4 | −22.3 | 2.1 | 130 | 30 |
| 5 | −20.3 | 2.4 | 130 | 30 |
| 6 | −25.3 | −19.4 | 130 | 30 |
| 7 | −9.2 | −9.5 | 130 | 30 |
| 8 | −20.7 | 3.4 | 130 | 30 |
| 9 | −20.7 | 3.4 | 130 | 30 |
| 10 | −19.3 | 1.2 | 145 | 29 |
| 11 | −20.4 | 2.2 | 145 | 32 |
| 12 | −24.1 | 3.9 | 130 | 28 |
| 13 | −25.0 | 4.7 | 130 | 30 |
| 14 | −23.3 | 2.9 | 130 | 30 |

*1: amount of charge in the developing zone
*2: amount of charge downstream of the transferring zone
*3: minimum fixation temperature The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A toner for developing an electrostatic latent image, comprising toner particles having an average surface roughness of at least 0.86, said average surface roughness being an average of SF1 of respective toner particles, where SF1 is defined as follows:

$$SF1=Le/Lp$$

wherein Le and Lp represent the length of the minimum envelope line and the peripheral length of each toner particle, respectively.

2. A toner as claimed in claim 1, wherein said toner particles have a roundness SF2 of at least 0.67, said roundness SF2 being defined as follows:

$$SF2=4S/(P^2\times\pi)$$

wherein S and P represent the area and the maximum diameter of each toner particle, respectively.

3. A toner as claimed in claim 2, wherein said toner particles have an average shape index SF3 of at least 0.64, said average shape index SF3 being a product of said average of SF1 and an average of SF2, where SF1 and SF2 are as defined above.

4. A toner as claimed in claim 1, further comprising silicon oxide particles having a diameter not greater than 1/10 of the volume average particle diameter of said toner particles.

5. A toner as claimed in claim 1, and having a volume specific resistance in the range of between $1\times10^{10}$ and $3\times10^{12}$ Ωcm.

6. A toner as claimed in claim 1, wherein said toner particles have a volume average particle diameter Dv and a number average particle diameter Dn and wherein Dv and Dn meet with the following condition:

$$Dn/Dv\leqq1.3.$$

7. A toner as claimed in claim 1, wherein each of said toner particles contains magnetic particles having an average diameter of between 0.01 and 0.20 μm.

8. A toner as claimed in claim 1, wherein said toner particles have a volume average diameter of between 5 and 9 μm.

9. A toner as claimed in claim 1, wherein each of said toner particles contains at least 50% by weight of a polyester resin.

10. A toner as claimed in claim 1, wherein each of said toner particles contains from 5 to 20% by weight of a petroleum, resin having a hydrogenation degree of at least 50%.

* * * * *